US010975322B2

(12) United States Patent
Racha et al.

(10) Patent No.: US 10,975,322 B2
(45) Date of Patent: Apr. 13, 2021

(54) FUEL COMPOSITION AS LUBRICITY IMPROVER AND METHOD THEREOF

(71) Applicant: BHARAT PETROLEUM CORPORATION LIMITED, Mumbai Maharashtra (IN)

(72) Inventors: Arundhathi Racha, Mumbai Maharashtra (IN); Chiranjeevi Thota, Mumbai Maharashtra (IN); Dattatraya Tammanna Shastri Gokak, Mumbai Maharashtra (IN); Vivek Kothuram Gajbhiye, Mumbai Maharashtra (IN); Sanjay Bhargava, Mumbai Maharashtra (IN)

(73) Assignee: Bharat Petroleum Corporation Limited, Mumbia Maharashtra (IN)

( * ) Notice: Subject to any disclaimer, the term of this patent is extended or adjusted under 35 U.S.C. 154(b) by 159 days.

(21) Appl. No.: 15/598,252

(22) Filed: May 17, 2017

(65) Prior Publication Data

US 2018/0023015 A1 Jan. 25, 2018

(30) Foreign Application Priority Data

Jul. 21, 2016 (IN) ..... 201621025072

(51) Int. Cl.

| | |
|---|---|
| ***C10L 10/08*** | (2006.01) |
| ***C10L 1/18*** | (2006.01) |
| ***C10L 1/188*** | (2006.01) |

(52) U.S. Cl.

CPC ..... *C10L 10/08* (2013.01); *C10L 1/18* (2013.01); *C10L 1/1881* (2013.01); *C10L 2200/043* (2013.01); *C10L 2200/0423* (2013.01); *C10L 2200/0446* (2013.01);

(Continued)

(58) Field of Classification Search

CPC ..... C10L 10/08; C10L 1/18; C10L 2200/043; C10L 2200/0423; C10L 2200/0446; C10L 2270/04; C10L 2270/023; C10L 1/1881; C10L 2270/026; C11B 1/00; C11B 3/06; C11B 3/14

See application file for complete search history.

(56) References Cited

U.S. PATENT DOCUMENTS 4,870,135 A * 9/1989 Mowdood ..... C08K 5/09 525/236
5,714,670 A * 2/1998 Fehr ..... A01H 1/04 426/601

(Continued)

FOREIGN PATENT DOCUMENTS

CN 101691506 A * 4/2010
JP 2006307042 A * 11/2006

(Continued)

OTHER PUBLICATIONS

EN 590 Diesel Fuel DS DIN EN 590 (Year: 2009).*

(Continued)

*Primary Examiner* — Pamela H Weiss
(74) *Attorney, Agent, or Firm* — Robert L. Stearns; Dickinson Wright, PLLC

(57) ABSTRACT

The present disclosure provides a fuel composition for improving the lubricity property. Further provided is a process for preparation of the composition.

3 Claims, 4 Drawing Sheets

Fuel additive composition

(52) U.S. Cl.
CPC ... *C10L 2270/023* (2013.01); *C10L 2270/026* (2013.01); *C10L 2270/04* (2013.01)

(56) References Cited

U.S. PATENT DOCUMENTS 5,861,187 A * 1/1999 Debonte ..... A01H 5/10 426/417
6,129,772 A * 10/2000 Weers ..... C10L 1/14 44/385
6,239,298 B1 5/2001 Williamson et al.
6,284,007 B1 * 9/2001 Tao ..... C10L 5/44 431/288
6,293,977 B1 9/2001 Caprottl et al.
6,402,797 B1 6/2002 Lin et al.
6,562,086 B1 5/2003 Gentry et al.
6,610,111 B2 * 8/2003 Krull ..... C10L 1/14 44/385
RE40,758 E * 6/2009 Krull ..... C10L 1/14 44/385
7,789,918 B2 9/2010 Tull et al.
8,361,173 B2 * 1/2013 Knuth ..... A23D 9/00 44/385
8,518,128 B2 8/2013 Reaney et al.
8,557,002 B2 10/2013 Yang et al.
2004/0123517 A1 * 7/2004 Caprotti ..... C10L 1/14 44/385
2004/0224017 A1 * 11/2004 Mulye ..... A61K 9/205 424/468
2006/0288638 A1 * 12/2006 Schwab ..... C10L 1/14 44/412
2010/0058651 A1 * 3/2010 Knuth ..... C11C 1/08 44/385
2010/0131847 A1 * 5/2010 Sievert ..... G06Q 30/0254 715/719
2015/0243407 A1 * 8/2015 Nair ..... H01B 3/20 252/579

FOREIGN PATENT DOCUMENTS

JP 2007231197 A * 9/2007
JP 2015172186 A * 10/2015
WO WO-0138461 A1 * 5/2001 ..... C10L 1/143

OTHER PUBLICATIONS

D396-19 Standard Specification for Fuel Oils downloaded 2020 (Year: 2019).*
Standard Test Method ASTM D 6079 (Year: 2018).*
D396-01 Standard Specification for Fuel Oils downloaded 2020 (Year: 2001).*
ASTM 975 20 a standard specification for diesel fuel (Year: 2020).*
ASTM 3699-19 Standard Specification for Kerosene (Year: 2020).*
ASTM D1655-20 Standard Specification for Aviation Turbine Fuel (Year: 2020).*
ASTM D 8275-19a (Year: 2020).*
ASTM D 4814-17 (Year: 2017).*

* cited by examiner

Fuel additive composition

Fuel additive composition

FUEL COMPOSITION AS LUBRICITY IMPROVER AND METHOD THEREOF

CROSS REFERENCE TO RELATED APPLICATION

This U.S. Utility Application claims priority to India Patent Application No. 201621025072, filed Jul. 21, 2016, and is incorporated herein by reference.

BACKGROUND OF THE INVENTION

1. Technical Field

The subject matter described herein in general relates to an additive as a lubricity improver comprising of at least one saturated fatty acid and at least one unsaturated fatty acid. This subject matter further relates to a fuel composition comprising said additive. The subject matter also relates to a process for the preparation of a fuel composition for imparting lubricant property.

2. Related Art

Recent concerns over the adverse environmental impact of diesel powered engines have driven various countries to legislate on reductions in vehicle exhaust emission levels and changes to diesel fuel quality. These reductions in exhaust emissions have caused changes in engine design, such as increased fuel injection pressure and control of the fuel injection. Hardware changes tend to require improved diesel lubricity to avoid excessive wear of the fuel injection system. Fuel composition is a key factor in determining the lubricity of fuels, which depends on the base crude oil, refinery process, and blending method. The gradual increase in severity of refinement of fuel oils in refinery to meet new environmental regulations has reduced lubricity property of automotive diesel fuel.

Lubricity additives have been developed to compensate for the deterioration in natural lubricity. A moderate dosage of suitable additive is beneficial in most cases, however a higher dosage of diesel-fuel additives can lead to numerous problems, such as fuel injector deposits, water separation problems, or premature filter plugging. These problems may adversely affect field performance of automobiles.

Free fatty acids, or fatty acids with unsaturation, have long been recognized as effective lubricity additives for diesel fuels. The fatty acids, fatty acid ammonium salts and fatty acid amides presently used as additives solidify on storage at low temperatures, sometimes even at room temperature, and cause handling problems. Many commercially available fatty acids are blended with a solvent to reduce crystal formation at lower temperatures. Diluting the additives with organic solvents only partly solves the problem, since fractions will still crystallize out from solutions or the solution will gel and solidify. Thus, for use as lubricity additives, the fatty acids, fatty acid ammonium salts and fatty acid amides either have to be greatly diluted or kept in heated storage vessels and added via heated pipe work which increases cost and complexity, U.S. Pat. No. 8,518,128 discloses fuel additive compositions comprising one or more hydrogen bonding compounds derived from a long chain fatty acid, and one or more esters of a second long chain fatty acid. The combination of a hydrogen bonding compound and fatty acid ester compound have beneficial characteristics that increase their efficacy in many applications. The compounds have elevated solubility in hydrocarbon fuels when compared with other lubricity-improving additives. This solubility property allows the additives to be introduced into fuel at relatively high concentrations that provide additional lubricant and combustion benefits.

U.S. Pat. No. 8,557,002 discloses a reaction product resulting from the chemical reaction of an alkyl phenol with an acid or an anhydride of saturated/unsaturated dicarboxylic acid. The major drawback of the reaction product which limits its use as lubricity improver is the formation of insoluble carboxylate salts coming from acid base reactions which could form filter blockage and affect vehicle operation and consequent fuel starvation.

U.S. Pat. No. 7,789,918 discloses an ester derivative derived from cashew nut shell liquid (CNSL). CNSL is the by-product obtained from cashew (*Anacardium occidentale* L.) processing industries and is a dark brown liquid. CNSL mainly consists of anacardic acid, cardol, cardanol and small amount of other phenols and less polar substances.

U.S. Pat. No. 6,610,111 discloses fatty acid mixtures from 1 to 99% by weight of at least one saturated mono- or dicarboxylic acid having from 6 to 50 carbon atoms, and from 1 to 99% by weight of at least one unsaturated mono- or dicarboxylic acid having from 6 to 50 carbon atoms, and at least one polar nitrogen-containing compound which is effective as paraffin dispersant in middle distillates, in an amount of from 0.01 to 90% by weight.

U.S. Pat. No. 6,562,086 discloses an alkanolamide of a fatty acid as a lubricity improver in low sulfur diesel fuel and spark ignition fuels. The lubricity of such fuels may be enhanced without acceptably increasing the tendency of the fuel to become hazy upon contact with water.

U.S. Pat. No. 6,402,797 discloses fuel oil composition comprising a major amount of a fuel oil and a minor amount of an additive comprising at least one fuel oil-soluble alkyl or alkoxy aromatic compound, wherein at least one group independently selected from alkyl and alkoxy groups of 1 to 30 carbon atoms is attached to an aromatic nucleus and at least one carboxyl group and optionally one or two hydroxyl groups are attached to the aromatic nucleus.

U.S. Pat. No. 6,293,977 discloses a method for improving the lubricity of a fuel oil with 1,2-epoxyethane which is a reaction product of polycarboxylic acid dimer and alkenyl succinic carboxylic acid. The dimer is a dimer of linoleic acid, oleic acid, linolenic acid or a mixture thereof.

U.S. Pat. No. 6,239,298 discloses a fuel lubricity additive made by a two-step process. The first step involves a reaction of an unsaturated base oil and a compound having a diene and a carboxylic acid group, the second step is esterifying or amidifying the free carboxylic acid group of anhydride with poly-hydroxy- or poly-amine compound to form lubricity additive fear diesel fuels.

SUMMARY

In an aspect of the present disclosure, there is provided a fuel composition imparting a lubricant property, the fuel composition comprising, a fuel; and an additive comprising at least one unsaturated fatty acid and at least one saturated fatty acid, wherein the ratio of the unsaturated fatty acid and the saturated fatty acid is in the range of 85:15 to 95:5.

In an aspect of the present disclosure, there is provided a process to prepare a fuel composition imparting a lubricant property, wherein the fuel composition includes a fuel; and an additive comprising at least one unsaturated fatty acid and at least one saturated fatty acid, wherein the ratio of the unsaturated fatty acid and the saturated fatty acid is in the range of 85:15 to 95:5.

These and other features, aspects, and advantages of the present subject matter will be better understood with reference to the following description and appended claims. This summary is provided to introduce a selection of concepts in a simplified form. This summary is not intended to identify key features or essential features of the claimed subject matter, nor is it intended to be used to limit the scope of the claimed subject matter.

BRIEF DESCRIPTION OF ACCOMPANYING DRAWINGS

The following drawings form part of the present specification and are included to further illustrate aspects of the present disclosure. The disclosure may be better understood by reference to the drawings in combination with the detailed description of the specific embodiments presented herein.

DETAILED DESCRIPTION

Figure 1:
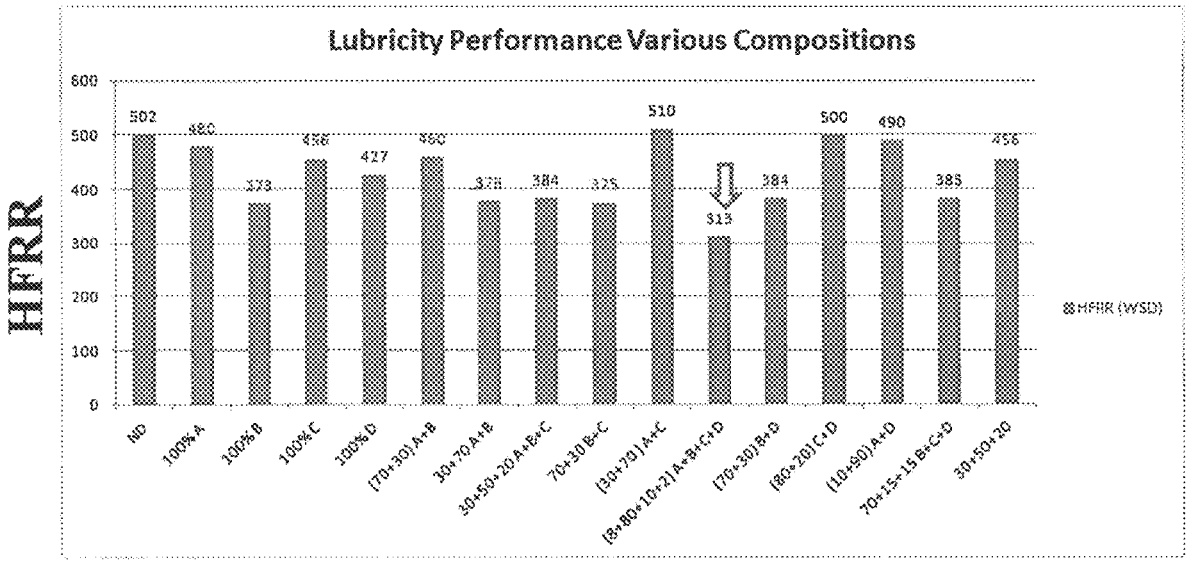
FIG. 1 depicts the graph showing HFRR vs fuel additive composition @50 ppm in BS-IV diesel fuel.

Those skilled in the art will be aware that the present disclosure is subject to variations and modifications other than those specifically described. It is to he understood that the present disclosure includes all such variations and modifications. The disclosure also includes all such steps, features, compositions and compounds referred to or indicated in this specification, individually or collectively and any and all combinations of any or more of such steps or features.

Definitions:

For convenience, before further description of the present disclosure, certain terms employed in the specification, and examples are collected here. These definitions should be read in the light of the remainder of the disclosure and understood as by a person of skill in the art. The terms used herein have the meanings recognized and known to those of skill in the art, however, for convenience and completeness, particular terms and their meanings are set forth below.

The articles "a", "an" and "the" are used to refer to one or to more than one (i.e., to at least one) of the grammatical object of the article.

The terms "comprise" and "comprising" are used in the inclusive, open sense, meaning that additional elements may be included. Throughout this specification, unless the context requires otherwise the word "comprise", and variations, such as "comprises" and "comprising", will be understood to imply the inclusion of a stated element or step or group of element or steps but not the exclusion of any other element or step or group of element or steps.

The term "composite(s)" and "composition(s)" are used interchangeably in the present disclosure.

The term HFRR refers to High Frequency Reciprocating Rig.

The term "hexadecanoic acid" and "palmitic acid" are used interchangeably in the present disclosure.

The term "Cloud Point" (CPT) refers to the temperature at which there is a pressure of a wax cloud in the fuel.

The term "Pour Point" (PPT) refers to the lowest temperature at which the fuel can flow and below which the fuel tends to freeze or ceases to flow.

Ratios, concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited.

The disclosure in general relates to a composition to develop a lubricity improver for use in low sulfur fuel, from hydrocracker plant. The present disclosure provides lubricity additives that enhance the lubricity of the fuel, making, clear homogeneous mixture and free flow able liquid at ambient as well as low temperature.

The lubricating properties of different additives with low sulfur diesel fuels have been discussed. Surprisingly, the additives disclosed in present disclosure when used in a fuel composition exhibit lubricity down to the 460 μm wear scar diameter (WSD) level. The value of 460 μm was proposed by the European Committee for standardization (CEN) in February 1997, and generally adopted by the industry, as the minimum requirement for an acceptable field performance.

In an embodiment of the present disclosure, there is provided an additive for imparting a lubricant property, comprising; at least one unsaturated fatty acid and at least one saturated fatty acid.

In an embodiment of the present disclosure, there is provided an additive for imparting a lubricant property, comprising; at least one unsaturated fatty acid and at least one saturated fatty acid, wherein the ratio of the unsaturated fatty acid and the saturated fatty acid is in the range of 85:15 to 95:5.

In an embodiment of the present disclosure, there is provided an additive as described herein, wherein the at least one saturated fatty acid is selected from the group consisting of palmitic acid, decanoic acid, octanoic acid, heptonoic acid, nonanoic acid, undecanoic acid, do-decanoic acid heptadecanoic acid, and octadecanoic acid.

In an embodiment of the present disclosure, there is provided an additive as described herein, wherein the at least one saturated fatty acid is in an amount in the range of 5% to 15% wiw of the total additive content.

In an embodiment of the present disclosure, there is provided an additive as described herein, wherein the at least one unsaturated fatty acid is selected from the group consisting of oleic acid, linoleic acid, linolenic acid, myristoleic acid, palmitoleic acid, sapienic acid, elaidic acid, vaccenic acid, arachidonic acid, and erucic acid.

In an embodiment of the present disclosure, there is provided an additive as described herein, wherein the at least one unsaturated fatty acid is in an amount in the range of 85% to 95% w/w of the total additive content.

In an embodiment of the present disclosure, the additive optionally comprises 0.1-10% by weight of free fatty acid of the formula RCOOH in which R represents an alkyl alkenyl group with 10 to 20 carbon atoms.

In an embodiment of the present disclosure, there is provided an additive for imparting a lubricant property, comprising; at least one unsaturated fatty acid selected from the group consisting of oleic acid, linoleic acid, linolenic acid, myristoleic acid, palmitoleic acid, sapienic acid, elaidic acid, vaccenic acid, arachidonic acid, and erucic acid, and at least one saturated fatty acid selected from the group consisting of palmitic acid, decanoic acid, octanoic acid, heptonoic acid, nonanoic acid, undecanoic acid, do-decanoic acid heptadecanoic acid, and octadecanoic acid wherein the ratio of the unsaturated fatty acid and the saturated fatty acid is in the range of 85:15 to 95:5.

In an embodiment of the present disclosure, there is provided an additive for imparting a lubricant property, comprising; palmitic acid (A) and oleic acid (B) wherein the ratio of the A:B in the composition is in the range of (70-30):(30-70).

In an embodiment of the present disclosure, there is provided an additive for imparting a lubricant property, comprising; palmitic acid (A) and oleic acid (B) wherein the ratio of the A:B in the composition is 70:30.

In an embodiment of the present disclosure, there is provided an additive for imparting a lubricant property, comprising; palmitic acid (A) and oleic acid (B) wherein the ratio of the A:B in the composition is in the range of (30-70):(70-30).

In an embodiment of the present disclosure, there is provided an additive for imparting a lubricant property, comprising; palmitic acid (A) and oleic acid (B) wherein the ratio of the A:B in the composition is 30:70.

In an embodiment of the present disclosure, there is provided an additive for imparting a lubricant property, comprising; palmitic acid (A) and linoleic acid (C), wherein the ratio of the A:C in the composition is in the range of (30-70):(70-30).

In an embodiment of the present disclosure, there is provided an additive for imparting a lubricant property, comprising; palmitic acid (A) and linoleic acid (C), wherein the ratio of the A:C in the composition is 30:70.

In an embodiment of the present disclosure, there is provided an additive for imparting a lubricant property, comprising; oleic acid (B) and linoleic acid (C), wherein the ratio of the B:C in the composition is in the range of(70.30):(30-70).

In an embodiment of the present disclosure, there is provided an additive for imparting a lubricant property, comprising; oleic acid (B) and linoleic acid (C), wherein the ratio of the B:C in the composition is 70:30.

In an embodiment of the present disclosure, there is provided an additive for imparting a lubricant property, comprising; palmitic acid (A), oleic acid (B) and linoleic acid (C) wherein the ratio of the A:B:C in the composition is in the range of (20-40):(40-60):(10-30).

In an embodiment of the present disclosure, there is provided an additive for imparting a lubricant property, comprising; palmitic acid (A), oleic acid (B) and linoleic acid (C) wherein the ratio of the A:B:C in the composition is 30:50:20.

In an embodiment of the present disclosure, there is provided an additive for imparting a lubricant property, comprising palmitic acid (A); oleic acid (B); linoleic acid (C) and linolenic acid (D), wherein the ratio of A:B:C:D in the composition is in the range of (5-15):(78-82):(8-12):(1:4).

In an embodiment of the present disclosure, there is provided an additive for imparting a lubricant property, comprising palmitic acid; oleic acid; linoleic acid and linolenic acid, wherein the ratio of A:B:C:D are present in a ratio of 8:80:10:2.

In an embodiment of the present disclosure, there is provided a process for preparing the additive, the process comprising the steps of, mixing at least one saturated and at least one unsaturated fatty acid to obtain an additive, wherein the ratio of the unsaturated fatty acid and the saturated fatty acid is in the range of 85:15 to 95:5.

In another embodiment, the present disclosure provides a process wherein at least one unsaturated fatty acid selected from the group consisting of oleic acid, linoleic acid, linolenic acid, myristoleic acid, palmitoleic acid, sapienic acid, elaidic acid, vaccenic acid, arachidonic acid, and erucic acid, and at least one saturated fatty acid selected from the soup consisting of palmitic acid, decanoic acid, octanoic acid, heptonoic acid, nonanoic acid, undecanoic acid, do-decanoic acid heptadecanoic acid, and octadecanoic acid.

In another embodiment, the present disclosure provides a process wherein the additive is a mixture of palmitic acid (A); oleic acid (B); linoleic acid (C) and linolenic acid (D), wherein the ratio of A:B:C:D in the composition is in the range of (5-15):(78-82):(8-12):(1:4).

In another embodiment, the present disclosure provides a process wherein the additive is a mixture of palmitic acid (A); oleic acid (B); linoleic acid (C) and linolenic acid (D), wherein the ratio of A:B:C:D are present in a ratio of 8:80:10:2.

In an embodiment of the present disclosure, there is provided a fuel composition imparting a lubricant property, the fuel composition comprising: a fuel; and an additive comprising at least one unsaturated fatty acid and at least one saturated fatty acid, wherein the ratio of the saturated fatty acid and the unsaturated fatty acid is in the range of 85:15 to 95:5.

In an embodiment of the present disclosure, there is provided a fuel composition imparting a lubricant property, the fuel composition comprising: a fuel having a Sulphur concentration less than 50 ppm; and an additive comprising at least one unsaturated fatty acid and at least one saturated fatty acid.

In an embodiment of the present disclosure, there is provided a fuel composition imparting a lubricant property, the fuel composition comprising: fuel having a sulphur concentration less than 50 ppm; and an additive comprising at least one unsaturated fatty acid and -at least one saturated fatty acid, wherein the ratio of the unsaturated fatty acid and the saturated fatty acid is in the range of 85:15 to 95:5.

In an embodiment of the present disclosure, there is provided a fuel composition as described herein, wherein the at least one saturated fatty acid is selected from the group consisting of palmitic acid, decanoic acid, octanoic acid, heptonoic acid, nonanoic acid, undecanoic acid, do-decanoic acid heptadecanoic acid, and octadecanoic acid.

In an embodiment of the present disclosure, there is provided a fuel composition as described herein, wherein the at least one saturated fatty acid is in an amount in the range of 5 to 15% w/w of the total additive content.

In an embodiment of the present disclosure, there is provided a fuel composition as described herein, wherein the at least one unsaturated fatty acid is selected from the group consisting of oleic acid, linoleic acid, linolenic acid, myristoleic acid, palmitoleic acid, sapienic acid, elaidic acid, vaccenic acid, arachidonic acid, and erucic acid.

In an embodiment of the present disclosure, there is provided a fuel composition as described herein, wherein the at least one unsaturated fatty acid is in an amount in the range of 85% to 95% w/w of the total additive content.

In an embodiment of the present disclosure, the fuel composition optionally comprises 0.1-10% by weight of free fatty acid of the formula RCOOH in which R represents an alkyl/alkenyl group with 10 to 20 carbon atoms.

In an embodiment of the present disclosure, there is provided a fuel composition for imparting a lubricant property, comprising; fuel having a sulphur concentration less than 50 ppm; and an additive comprising at least one unsaturated fatty acid selected from the group consisting of oleic acid, linoleic acid, linolenic acid, myristoleic acid, palmitoleic acid, sapienic acid, elaidic acid, vaccenic acid, arachidonic acid, and erucic acid, and at least one saturated fatty acid selected from the group consisting of palmitic acid, decanoic acid, octanoic acid, heptonoic acid, nonanoic acid, undecanoic acid, do-decanoic acid heptadecanoic acid, and octadecanoic acid, wherein the ratio of the unsaturated fatty acid and the saturated fatty acid is in the range of 85:15 to 95:5.

In an embodiment of the present disclosure, there is provided a fuel composition for imparting a lubricant property, comprising fuel having a Sulphur concentration less than 50 ppm; and an additive comprising palmitic acid (A) and oleic acid (B) wherein the ratio of the A:B in the composition is in the range of (70-30):(30-70).

In an embodiment of the present disclosure, there is provided a fuel composition for imparting a lubricant property, comprising fuel having a sulphur concentration less than 50 ppm; and an additive comprising palmitic acid (A) and oleic acid (B) wherein the ratio of the A:B in the composition is 70:30.

In an embodiment of the present disclosure, there is provided a fuel composition for imparting a lubricant property, comprising fuel having a sulphur concentration less than 50 ppm; and an additive comprising palmitic acid (A) and oleic acid (B) wherein the ratio of the A:B in the composition is 30:70.

In an embodiment of the present disclosure, there is provided a fuel composition for imparting a lubricant property, comprising fuel having a sulphur concentration less than 50 ppm; and an additive comprising palmitic acid (A) and linoleic acid (C) wherein the ratio of the A:C in the composition is in the range of (70-30):(30-70).

In an embodiment of the present disclosure, there is provided a fuel composition for imparting a lubricant property, comprising fuel having a sulphur concentration less than 50 ppm; and an additive comprising palmitic acid (A) and linoleic acid (C) wherein the ratio of the A:C in the composition is 70:30.

In an embodiment of the present disclosure, there is provided a fuel composition for imparting a lubricant property, comprising fuel having a sulphur concentration less than 50 ppm; and an additive comprising oleic acid (B) and linoleic acid (C) wherein the ratio of the B:C in the composition is (70-30):(30-70).

In an embodiment of the present disclosure, there is provided a fuel composition for imparting a lubricant property, comprising fuel having a sulphur concentration less than 50 ppm; and an additive comprising oleic acid (B) and linoleic acid (C) wherein the ratio of the B:C in the composition is 70:30.

In an embodiment of the present disclosure, there is provided a fuel composition for imparting a lubricant property, comprising fuel having a sulphur concentration less than 50 ppm; and an additive comprising palmitic acid (A), oleic acid (B) and linoleic acid (C) wherein the ratio of the A:B:C in the composition is in the range of(20-40):(40-60):(10-30).

In an embodiment of the present disclosure, there is provided a fuel composition for imparting a lubricant property, comprising fuel having a sulphur concentration less than 50 ppm; and an additive comprising palmitic acid (A), oleic acid (B) and linoleic acid (C) wherein the ratio of the A:B:C in the composition is 30:50:20.

In an embodiment of the present disclosure, there is provided a fuel composition for imparting a lubricant property, comprising fuel having a sulphur concentration less than 50 ppm; and an additive comprising palmitic acid (A); oleic acid (B); linoleic acid (C) and linolenic acid (D), wherein the ratio of A:B:C:D in the composition is in the range of (5-15):(78-82):(8-12):(1:4).

In an embodiment of the present disclosure, there is provided a fuel composition for imparting a lubricant property, comprising fuel having a sulphur concentration less than 50 ppm; and an additive comprising palmitic acid; oleic acid; linoleic acid and linolenic acid, wherein the ratio of A:B:C:D are present in a ratio of 8:80:10:2.

In an embodiment of the present disclosure, there is provided a fuel composition for imparting a lubricant property, comprising fuel having a sulphur concentration in the range of 25-50 ppm; and an additive comprising palmitic acid; oleic acid; linoleic acid and linolenic acid, wherein the ratio of A:B:C:D are present in a ratio of 8:80:10:2.

In an embodiment of the present disclosure, there is provided a fuel composition for imparting a lubricant property, comprising fuel having a sulphur concentration in the range of 20-40 ppm; and an additive comprising palmitic acid; oleic acid; linoleic acid and linolenic acid, wherein the ratio of A:B:C:D are present in a ratio of 8:80:10:2.

In an embodiment of the present disclosure, there is provided a fuel composition as described herein, wherein the additive is at a concentration range of 50 to 150 ppm by weight of the fuel.

In an embodiment of the present disclosure, there is provided a fuel composition as described herein, wherein the fuel is selected from the group consisting of diesel, kerosene, gasoline, jet fuel and combinations thereof.

In an embodiment of the present disclosure, there is provided a process for producing a fuel composition for imparting a lubricant property.

In an embodiment of the present disclosure, there is provided a diesel composition imparting a lubricant property, the fuel composition comprising: fuel having a sulphur concentration less than 50 ppm; and an additive comprising at least one unsaturated fatty acid and at least one saturated fatty acid, wherein the ratio of the unsaturated fatty acid and the saturated fatty acid is in the range of 85:15 to 95:5.

In an embodiment of the present disclosure, there is provided a diesel composition for imparting a lubricant property, comprising fuel having a sulphur concentration less than 50 ppm; and an additive comprising palmitic acid; oleic acid; linoleic acid and linolenic acid, wherein the ratio of A:B:C:D is 8:80:10:2.

In an embodiment of the present disclosure, there is provided a fuel composition for imparting a lubricant property, comprising fuel having a sulphur concentration less than 50 ppm; an additive comprising palmitic acid; oleic acid; linoleic acid and linolenic acid, wherein the ratio of A:B:C:D is 9:80:10:2 and 0.1-10% by weight of free fatty acid of fornult RCOOH in which R represent an alkyl/alkenyl group with 10 to 20 carbon atoms.

The present disclosure describes that an alkyl alkenyl moiety having a carboxyl group is likely to be most effective in improving the lubricity. Electrons of double bonds in the carbon chain are also very effective in improving lubricity. The sequence of oxygenated and unsaturation groups to improve lubricity according to above lubricity improving composition is as follows: tri-C═C—COOH>di-C═C—COOH>mono-C═C—COOH>—COOH. The improved lubricity caused by COOH and unsaturation groups correlates with the known observation of ionic interaction of the metal substrate with the lubricant molecules caused by hydrogen bonds and the Debye orientation forces, which are much stronger than the interaction based on the van der Wools forces. Therefore, the addition of free fatty acids in the lubricity improving composition containing hexadacanoic acid for fuels with low lubricity improves lubricity Further investigation has proven that the fatty acids: oleic acid (C18: 1), linoleic acid (C18: 2) and linolenic acid (C18: 3), with the increase of the degree of unsaturation, increases the lubricity of the fuel.

In addition to the above, oxygen containing fatty acids along with unsaturation are superior friction reducing agents. These compounds adsorb or react on rubbing surfaces to reduce adhesion between contacting asperities and limit friction, wear and seizure. Further, the introduction of use of naturally available mono-acidic lubricity additives will lead to being accepted as a cost effective and safe option to existing lubricity additives.

The present disclosure further clearly discloses that the property of lubricity helps to determine the fuel's ability to minimize engine wear and to maximize engine life. The HFRR test D6751 typically used to measure lubricity, and with a 520 microns wear scar now set by ASTMD27 as the maximum wear scar acceptable for diesel fuel. However, the engine manufacturers and many state and local agencies require the more demanding 460 microns as the maximum acceptable wear scar.

The provision of the composition of the present disclosure is that it does not cause haziness when fuel comes in contact with water and this composition is effective in low dosage. The lubricity increase is in range of 20-100 ppm. The diesel fuels that are useful in this invention can be of any type of diesel fuel defined by ASTM D-396. The base fuels may comprise of saturated olefenic and aromatic hydrocarbons and these can be derived from straight run streams, thermally or catalytically cracked hydrocarbon feed stocks, hydro cracked petroleum fractions or catalytically reformed hydrocarbons. The sulfur content of the diesel fuel may range from 50 ppm to 0.2591 by weight. Any type of diesel fuel with suitable viscosity and boiling range can be used in present invention. The anti-wear and lubricity performance of the fuel compositions are measured using high frequency reciprocating rig test (HFRR; ISO 12156-2:1998). Both friction and contact resistance are monitored throughout the test. The tests are conducted according to standard procedure published in CEC F-06-A 96 in which load of 200 grams is applied at temperature 60° C., for 75 min. at stroke length of 1 mm at the reciprocating frequency of 50 HZ. A series of test samples of the present invention were blended in diesel fuel and HFRR studies were carried out. The diesel fuel specification IS: 1460 specifies 0.46 mm (max.) or 460 microns as HFRR value, under which a diesel fuel is considered as having a sufficient lubricity. This limit was set as a lubricity specification when marketing EURODIESEL in 1996, since when practically no pump failure caused by insufficient lubricity of this fuel has occurred in the field, when lubricity is provided naturally by the fuel itself or restored by lubricity improvers. The lubricity improver for the present invention contains components of free fatty acids with specific ratios. The free fatty acids can be any fatty acid or mixture of fatty acids having alkyl chain of 10-20 carbon atoms.

In an embodiment of the present disclosure, there is provided a composition for imparting a lubricant property, comprising fuel having a sulphur concentration less than 50 ppm; and an additive comprising palmitic acid; oleic acid; linoleic acid and inolenic acid, wherein the ratio of A:B:C:D are present in a ratio of 8:80:10:2 for use as an additive.

In an embodiment, the present disclosure comprises a diesel fuel having less than 50 ppm sulfur containing lubricity improving additive composition comprising of 50-100 ppm of component A as an additive having the formulae $C_{16}H_{32}O_2$ added to the base diesel fuel gave an HFRR value of 480 and 404 microns respectively.

In another embodiment, the present disclosure comprises a diesel fuel having less than 50 ppm sulfur containing an lubricity improving additive composition comprising of 50-100 ppm of component B as an additive of the formulae $C_{18}H_{34}O_2$ added to the base diesel fuel gave an HFRR value of 480 and 404 microns.

In an embodiment, the present disclosure provides a method for increasing the lubricity of a fuel comprising adding a lubricating-effective amount of the composition comprising fuel having a sulphur concentration less than 50 ppm; and an additive comprising palmitic acid; oleic acid; linoleic acid and linolenic acid, wherein the ratio of A:B:C:D are present in a ratio of 8:80:10:2 to the fuel.

In another embodiment, the present disclosure provides a method for improving diesel fuel lubricity additive, wherein the additive comprises palmitic acid (A), oleic acid (B), linoleic acid (C) and linolenic acid (D), wherein the additive composition comprising A:B:C:D is present in a ratio of 8:80:10:2.

In an embodiment of the present disclosure, there is provided a process for producing a fuel composition for imparting a lubricant property, the process comprising the steps of: mixing at least one saturated and at least one unsaturated fatty acids to obtain an. additive; contacting the additive with a fuel to obtain a fuel composition, In another embodiment, the present disclosure provides a process wherein the additive is present in the fuel composition in an amount within the range of from 50 to 100 parts of additive by weight per million parts by weight of fuel.

In another embodiment, the present disclosure provides a process wherein at least one unsaturated fatty acid selected from the group consisting of oleic acid, linoleic acid, linolenic acid, myristoleic acid, palmitoleic acid, sapienic acid, elaidic acid, vaccenic acid, arachidonic acid, and erucid acid, and at least one saturated fatty acid selected from the group consisting of palmitic, acid, decanoic acid, octanoic acid, heptonoic acid, nonanoic acid, undecanoic acid, dodecanoic acid heptadecanoic acid, and octadecanoic acid wherein the ratio of the unsaturated fatty acid and the saturated fatty acid is in the range of 85:15 to 95:5.

In another embodiment, the present disclosure provides a process wherein the additive is a mixture of palmitic acid (A); oleic acid (B); linoleic acid (C) and linolenic acid (D), wherein the ratio of A:B:C:D in the composition is in the range of (5-15):(78-82):(8-12):(1:4).

In another embodiment, the present disclosure provides a process wherein the additive is a mixture of palmitic acid (A); oleic acid (B); linoleic acid (C) and linolenic acid (D), wherein the ratio of A:B:C:D are present in a ratio of 8:80:10:2.

The additive composition are surface active compounds, consisting of active polar head groups which permits the formation of a protective film on moving metal surfaces and a hydrocarbon tail to assist fuel solubility. The long chain polar compounds employed in lubricity improver additive permit the establishment of molecular coating on the metal surface. This film or boundary layer provides a cushion which keeps metal surfaces apart and thus protects against wear. The micelles formed by the dimer acids are oligomeric/polymeric in nature in contrast to the micelles formed by the monoacidic lubricity additives.

Although the subject matter has been described in considerable detail with reference to certain embodiments thereof, other embodiments are possible.

EXAMPLES

The following examples are given by way of illustration of the present invention and should not be construed to limit the scope of present disclosure. It is to be understood that both the foregoing general description and the following detailed description are exemplary and explanatory only and are intended to provide further explanation of the claimed subject matter.

Example 1

Standard Test Method for Evaluating Lubricity of Diesel Fuels by the High-Frequency Reciprocating Rig (HFRR; ISO 12156-2:1998)

Diesel fuel injection equipment has some reliance on lubricating properties of the diesel fuel. Shortened life of engine components, such as diesel fuel injection pumps and injectors, has sometimes been ascribed to lack of lubricity in a diesel fuel.

The trend of HFRR test results to diesel injection system pump component distress due to wear has been demonstrated in pump rig tests for some fuel/hardware combinations where boundary lubrication is believed to be a factor in the operation of the component.

The wear scar generated in the HFRR test is sensitive to contamination of the fluids and test materials, the temperature of the test fuel, and the ambient relative humidity. Lubricity evaluations are also sensitive to trace contaminants acquired during test fuel sampling and storage.

The HERB (Test Method ASTM D6079) and Scuffing Load Ball on Cylinder Lubricity Evaluator (SLBOCLE, Test Method D6078) are two methods for evaluating diesel fuel lubricity. However, no absolute correlation has been developed between the two test methods.

The HFRR may be used to evaluate the relative effectiveness of diesel fuels for preventing wear under the prescribed test conditions. Correlation of HFRR test results with field performance of diesel fuel injection systems has not yet been determined.

This test method is designed to evaluate boundary lubrication properties. While viscosity effects on lubricity in this test method are not totally eliminated, they are minimized.

The testing parameters and conditions are conformed to CEC-F-06-A-96 standard (CEC,1996).

A 2-mL test specimen of fuel is placed in the test reservoir of an HFRR and adjusted to either of the standard temperatures (25 or 60° C.). The preferred test temperature is 60° C., except where there may be concerns about loss of fuel because of its volatility or degradation of the fuel because of the temperature.

When the fuel temperature has stabilized, a vibrator arm holding a nonrotating steel ball and loaded with a 200 g mass is lowered until it contacts a test disk completely submerged in the fuel. The ball is caused to rub against the disk with a 1-mm stroke at a frequency of 50 Hz for 75 min.

The ball is removed from the vibrator arm and cleaned. The dimensions of the major and minor axes of the wear scar are measured under 100× magnification and recorded.

This test method is applicable to middle distillate fuels, and diesel fuels, in accordance with Specification D975; and other similar petroleum-based fuels which can be used in diesel engines. This test method is also applicable to biodiesel blends.

The values stated in S1 units are to be regarded as standard. No other units of measurement are included in this standard.

Automotive diesel fuel must pass this standard with a wear scar diameter of less than or equal to 460 micro meter.

Example 2

Lubricity Performance

The Wear Scar Diameter (WSD) is the measure of lubricity performance of the lubricity additive in low sulfur diesel. WSD is measured by high frequency reciprocating rig (HFRR) by ISO-12156 test method in four different fuels, having varying amounts of sulphur (25-50 ppm). A ball is vibrated against a fiat metal specimen at 200 g load, 50 HZ frequency, 60° C. temperature, 1 mm amplitude for 75 minutes.

Example 3

Fuel was selected from hydro treated stream having less than 50 ppm (maximum) sulphur to screen and compare the lubricity improving additive compositions in laboratory for HFRR studies. The neat diesel fuel sample was sourced from refinery hydrocracker plant with sulphur varying from 30-50 ppm without any fuel additive added was measured for HFRR. The HFRR value was found to be 502 for the neat diesel sample which was not meeting the BIS specification of HFRR 460 micron.

Example 4

A lubricity improving chemical additive composition is comprised of fatty acids components of saturated and unsaturated free fatty acids of hexadecanoic acid, oleic acid, linoleic acid and linolenic acid labeled A, B, C and D, these chemicals which can he obtained from natural resources are purchased for experimental purpose.

Example 5

The fuel composition of said lubricity improving additive composition, component A is unsaturated free fatty acid of hexadecanoic acid present in the fuel composition in an amount within the range of about 50 to about 100 parts of additive by weight per million parts by weight of fuel. The HFRR value of the lubricity additive composition of component A, within the range of from about 50 to about 100 parts of additive by weight per million parts by weight of fuel was found to be 480 and 404 micron respectively.

Example 6

In another typical example, the fuel composition of said lubricity improving additive composition, component B is mono unsaturated free fatty acid of oleic acid present in the fuel composition in an amount within the range of from about 50 to about 100 parts of additive by weight per million parts by weight of fuel. The HFRR value of the lubricity additive composition of component B, within the range of from about 50 to about 100 parts of additive by weight per million parts by weight of fuel was found to be 373 and 390 micron respectively.

Example 7

In another typical example, the fuel composition of said lubricity improving additive composition, component C is a di-unsaturated free fatty acid of linoleic acid present in the fuel composition in an amount within the range of from about 50 to about 100 parts of additive by weight per million parts by weight of fuel. The HFRR value of the lubricity additive composition of component C, within the range of from about 50 to about 100 parts of additive by weight per million parts by weight of fuel was found to be 456 and 470 micron respectively.

High concentration of 100 ppm of linoleic acid doesn't meet in accordance with ASTM D6079 specifications: we assume, this may be due to linoleic acid typically poor oxidative stability and its sensitivity to air and light. It undergoes oxidation across carbon double bonds. [1-2], Also, linoleic acid tends to form solid in a short time due to low freezing point −5° C., and therefore its usefulness is limited to engines that are regularly rebuilt, such as racing engines.

Example 8

In another typical example, the fuel composition of said lubricity improving additive composition, component D is tri-unsaturated free fatty acid of linolenic acid present in the fuel composition in an amount within the range of from about 50 to about 100 parts of additive by weight per million parts by weight of fuel. The HFRR value of the lubricity improving additive composition of component D, within the range of from about 50 to about 100 parts of additive by weight per million parts by weight of fuel was found to be 427 and 476 micron respectively.

In linolenic acid same as linoleic acid oxidiation across carbon double bonds increases due to increase in double bonds. Hence high concentration of 100 ppm of linolenic acid doesn't meet the D975 specifications.

Example 9

In another typical example, the fuel composition of said lubricity improving additive composition, is a mixture of saturated and mono-unsaturated free fatty acid of hexadecanoic acid and oleic acid in a ratio of 70:30, i.e mixture of component A (70% by wt) and component B (30% by wt) present in the fuel composition in an amount within the range of about 50 to about 100 parts of additive by weight per million parts by weight of fuel. The HFRR value of the lubricity improving additive composition for the mixture of component A and component B (70:30) within the range of about SO to about 100 parts of additive by weight per million parts by weight of fuel was found to be 460 and 440 micron respectively.

Example 10

In another typical example, the fuel composition of said lubricity improving additive composition, is a mixture of saturated and mono-unsaturated free fatty acid of hexadecanoic acid and oleic acid in a ratio of 30:70, i.e mixture of component A (30% by wt) and component B (70% by wt) present in the fuel composition in an amount within the range of about 50 to about 100 parts of additive by weight per million parts by weight of fuel. The HFRR value of the lubricity improving additive composition for the mixture of component A and component B (30:70) within the range of from about 50 to about 100 parts of additive by weight per million parts by weight of fuel was found to be 378 and 388 micron respectively.

Example 11

In another typical example, the fuel composition of said lubricity improving additive composition, is a mixture of saturated and unsaturated free fatty acids of hexadecanoic acid and linolenic acid in the ratio of 80:20 i.e. mixture of component A:D (10 and 90 by wt %) are present in the fuel composition in an amount within the range of about 50 to about 100 parts of additive by weight per million parts by weight of fuel. The HFRR value of the lubricity improving additive composition for the mixture of saturated and unsaturated free fatty acids of hexadecanoic acid and linolenic acid of component A, and component D, in the ratio of (10:90) within the range of about 50 to about 100 parts of additive by weight per million parts by weight of fuel was found to be 490 and 470 microns respectively.

Example 12

In another typical example, the fuel composition of said lubricity improving additive composition, is a mixture of saturated free fatty acid and di-unsaturated free fatty acids of hexadecanoic acid and linoleic acid in a ratio of 30:70, i.e mixture of component A (30% by wt) and component C (70% by wt) present in the fuel composition in an amount within the range of about 50 to about 100 parts of additive by weight per million parts by weight of fuel. The HFRR value of the lubricity improving additive composition for the mixture of component A and component C in the ratio of (30:70) within the range of about 50 to about 100 parts of additive by weight per million parts by weight of fuel was found to be 510 and 480 microns respectively. Without being bound by theory, it is presented that the A:C lubricity improving fuel additive composition, the component "A" is a simple unsaturated fatty acid and the component "C" is linoleic acid with two double bonds having poor oxidative stability, sensitive to air and light and oxidizes across carbon double bonds makes the lubricity improving fuel additive composition out of specifications according to ASTM D6079 specifications.

Example 13

In another typical example, the fuel composition of said lubricity improving additive composition, is a mixture of monosaturated and disaturated free fatty acid of oleic acid and linoleic acid in a ratio of 70:30, i.e mixture of component B (70% by wt) and component C (30% by wt) present in the fuel composition in an amount within the range of about 50 to about 100 parts of additive by weight per million parts by weight of fuel. The HFRR value of the lubricity improving additive composition for the mixture of component B and component C is in the ratio of (70:30) which is within the range of about 50 to about 100 parts of additive by weight per million parts by weight of fuel was found to be 375 and 367 micron respectively Example 14

In another typical example, the fuel composition of said lubricity improving additive composition, is a mixture of unsaturated free fatty acids of oleic acid and linolenic acid in the ratio of 70:30 i.e mixture of component B:D (70 and 30 by wt %) are present in the fuel composition in an amount within the range of about 50 to about 100 parts of additive by weight per million parts by weight of fuel. The HFRR value of the lubricity improving additive composition for the mixture unsaturated free fatty acids of oleic acid and linolenic acid of component B, and component D, is in the ratio of (70:30) i.e. within the range of about 50 to about 100 parts of additive by weight per million parts by weight of fuel, was found to be 384 and 324 micron respectively.

Example 15

In another typical example, the fuel composition of said lubricity improving additive composition, is a mixture of unsaturated free fatty acids of linoleic acid and linolenic acid in the ratio of 80:20, i.e mixture of component C:D (80 and 20 by wt %) are present in the fuel composition in an amount within the range of about 50 to about 100 parts of additive by weight per million parts by weight of fuel. The HFRR value of the lubricity improving additive composition for the mixture of unsaturated free fatty acids of linoleic acid and linolenic acid of component C, and component D, in the ratio of (80:20) within the range of about 50 to about 100 parts of additive by weight per million parts by weight of fuel was found to be 500 and 480 micron respectively. We assume that the two unsaturated fatty acids linoleic and linolenic acids with the degree of unsaturation the oxidation around the double bonds increase and this combination fails in accordance with ASTM D6079 lubricity improving specification.

Example 16

In another typical example, the fuel composition of said lubricity improving additive composition, is a mixture of saturated free fatty acid and mono- and di-unsaturated free fatty acid of hexadecanoic acid, oleic acid and linoleic acid in the ratio of 30:50:20, i.e mixture of component A (30% by wt); component B (70% by wt) and component C (20% by wt) present in the fuel composition in an amount within the range of about 50 to about 100 parts of additive by weight per million parts by weight of fuel. The HERR value of the lubricity improving additive composition for the mixture of component A, component B and component C (30:50:20) within the range of about 50 to about 100 parts of additive by weight per million parts by weight of fuel was found to be 384 and 324 micron respectively.

Example 17

In another typical example, the fuel composition of said lubricity improving additive composition, is a mixture of unsaturated free fatty acids of oleic, linoleic and linolenic acid in the ratio of 70:15:15 i.e mixture of component B:C:D (70, 15 and 15 by wt %) are present in the fuel composition in an amount within the range of about 50 to about 100 parts of additive by weight per million parts by weight of fuel. The HFRR value of the lubricity improving additive composition for the mixture of unsaturated free fatty acids of oleic, linoleic and linolenic acid of components B, C and component D, in the ratio of (70:15:15) within the range of about 50 to about 100 parts of additive by weight per million parts by weight of fuel was found to be 383 and 393 micron respectively.

Example 18

In another typical example, the fuel composition of said lubricity improving additive composition, is a mixture of saturated and unsaturated free fatty acids of hexadecanoic and linoleic and linolenic acid in the ratio of 30:50:20 i.e mixture of component A:C:D (30, 50 and 20 by wt %) are present in the fuel composition in an amount within the range of about 50 to about 100 parts of additive by weight per million parts by weight of fuel. The HFRR value of the lubricity improving additive composition for the mixture of saturated and unsaturated free fatty acids of hexadecanoic acid and linoleic and linolenic acid of component A, C and component D, in the ratio of (30:50:20) within the range of about 50 to about 100 parts of additive by weight per million parts by weight of fuel was found to be 456 and 501 micron respectively.

Example 19

In another typical example, the fuel composition of said lubricity improving additive composition, is a mixture of saturated and mono-, di- and tri-unsaturated free fatty acids of hexadecanoic, oleic, linoleic and linolenic acid in the ratio of 8:80:10:2, i.e. mixture of components A:B:C:D (8:80:10:2 by wt %) are present in the fuel composition in an amount within the range of about 50 to about 100 parts of additive by weight per million parts by weight of fuel. The HFRR value of the lubricity improving additive composition for the mixture of saturated and unsaturated fatty acids of component A, component B, component C and component D in the ratio of (8:80:10:2) within the range of about 50 to about 100 parts of additive by weight per million parts by weight of fuel was found to be 313 and 361 micron respectively.

Example 20

In another typical example, we have done fine tuning of the said lubricity improving additive composition, which is a mixture of saturated and unsaturated free fatty acids of hexadecanoic and linoleic and linolenic acid in varying ratio of i.e mixture of component A:B:C:D are present in the fuel composition in an amount within the range of about 50 parts of additive by weight per million parts by weight of fuel. A graph was plotted were composition of the lubricity additive fuel composition verses HFRR value respectively FIG. 1. The HFRR value of the lubricity improving additive composition for the mixture of saturated and unsaturated free fatty acids of hexadecanoic acid, Oleic acid and linoleic and linolenic acid of component in the ratio of A:B:C:D within the range of about 50 parts of additive by weight per million parts by weight of fuel was found to be best in component in the ratio of 8:80:10:2 of A:B:C:D within the range of about 50 parts of additive by weight per million parts by weight of fuel the HFRR value was found to be as minimum as 313 micron.

Example 21

Figure 2:
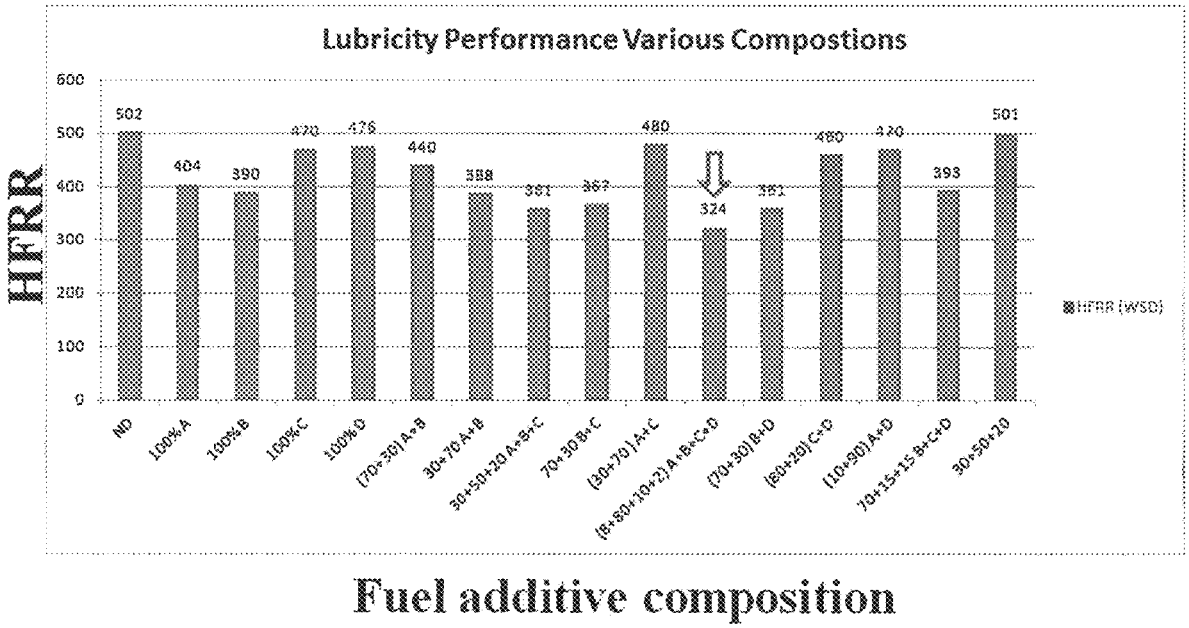
FIG. 2 depicts the graph showing HFRR vs fuel additive composition @25 ppm in BS-IV diesel fuel.

In another typical example, we have done fine tuning of the said lubricity improving additive composition, which is a mixture of saturated and unsaturated free fatty acids of hexadecanoic and linoleic and linolenic acid in varying ratio of Le mixture of component A:B:C:D are present in the fuel composition in an amount within the decreased range of about 50 parts of additive by weight per million parts by weight of fuel to 25 parts of additive by weight per million parts by weight of fuel. A graph was plotted were composition of the lubricity additive fuel composition verses HFRR value (FIG. 2). The HFRR value of the lubricity improving additive composition for the mixture of saturated and unsaturated free fatty acids of hexadecanoic acid, Oleic acid and linoleic and linolenic acid of component in the ratio of A:B:C:D within the decreased range of fuel additive composition about 50 parts of additive by weight per million parts by weight of fuel to 25 parts of additive by weight per million parts by weight of fuel was found to be best in component in the ratio of 8:80:10:2 of A:B:C:D within the range of about 25 parts of additive by weight per million parts by weight of fuel the HFRR value was found to be as minimum as 324 micron with slight increase in HFFR value 50 ppm of lubricity fuel additive composition to 25 ppm lubricity fuel additive composition in diesel.

Example 22

Figure 3:
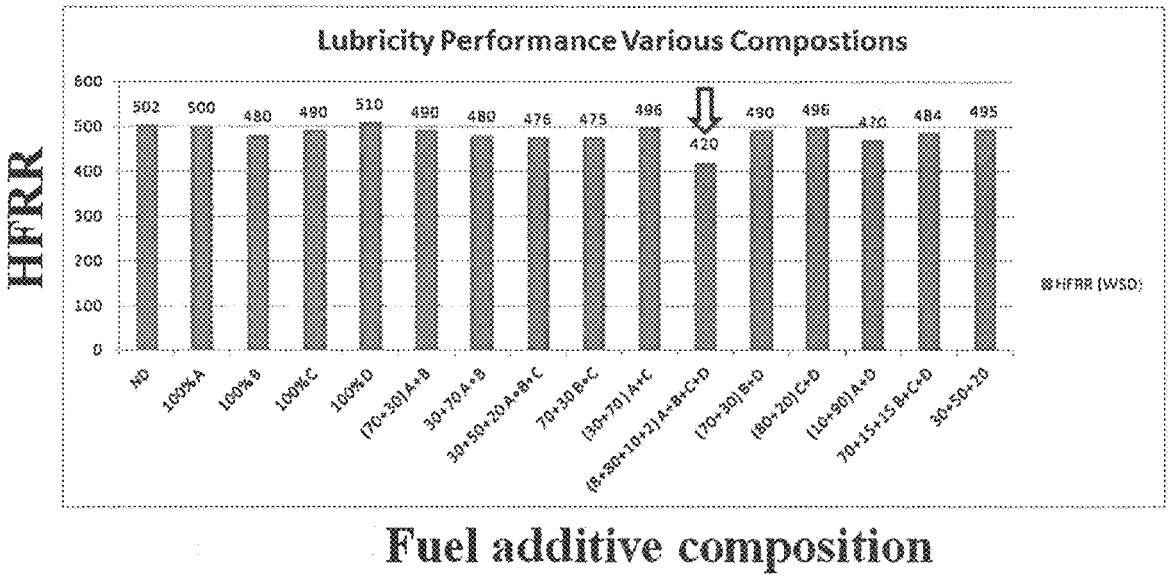
FIG. 3 depicts the graph showing HFRR. vs fuel additive composition @100 ppm in BS-IV diesel fuel.

In another typical example, we have done fine tuning of the said lubricity improving additive composition, which is a mixture of saturated and unsaturated free fatty acids of hexadecanoic and linoleic and linolenic acid in various the ratio of i.e mixture of component A:B:C:D are present in the fuel composition in an amount within the increased range of about 50 parts of additive by weight per million parts by weight of fuel to 100 parts of additive by weight per million parts by weight of fuel. A graph was plotted for composition of the lubricity additive fuel composition verses HFRR value (FIG. 3). The HFRR value of the lubricity improving additive composition for the mixture of saturated and unsaturated free fatty acids of hexadecanoic acid, Oleic acid and linoleic and linolenic acid of component in the ratio of A:B:C:D within the increased range of fuel additive composition about 50 parts of additive by weight per million parts by weight of fuel to 100 parts of additive by weight per million parts by weight of fuel was found to be best in component in the ratio of 8:80:10:2 of A:B:C:D within the range of about 100 parts of additive by weight per million parts by weight of fuel the HFRR value was found to be as minimum as 420 micron with slight increase in HFFR value 50 ppm of lubricity fuel additive composition to 25 ppm lubricity fuel additive composition in diesel.

Example 23

Figure 4:
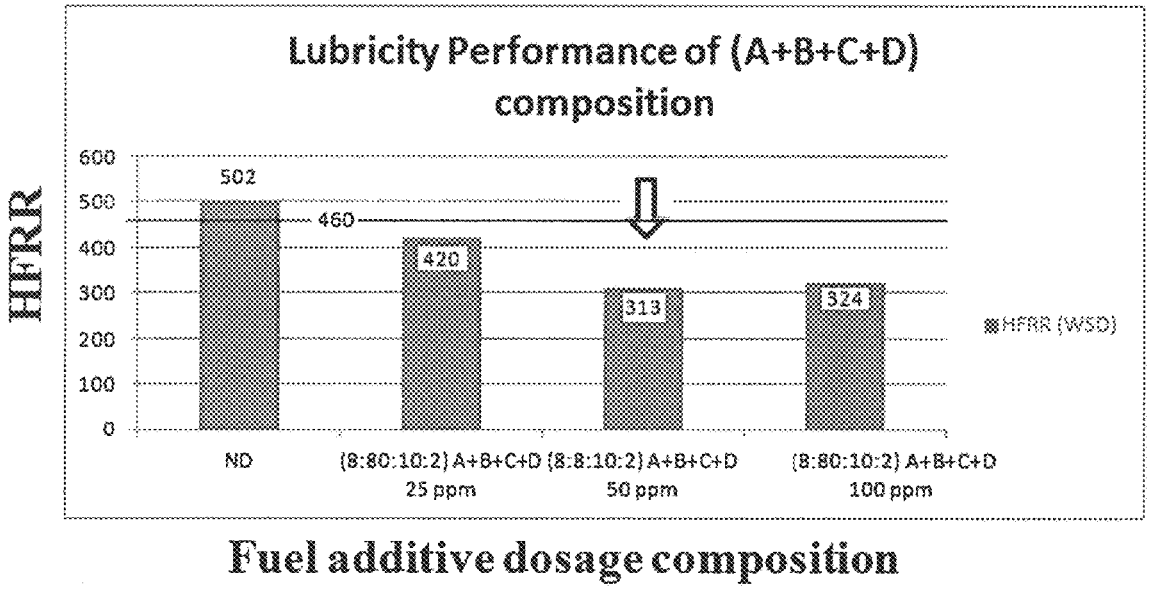
FIG. 4 depicts the graph showing HFRR vs fuel additive composition @25, 50 and 100 ppm in BS-IV diesel fuel.

In another typical example, a combined graph (FIG. 4), was plotted with the fuel composition of said lubricity improving additive composition, which is a mixture of monosaturated and unsaturated free fatty acid of hexadecanoic, and oleic, linoleic and linolenic acid in varying ratio of A:B:C:D present in the fuel composition in an amount of about 25, 50 and 100 parts of additive by weight per million parts by weight of fuel. The HFRR value of the lubricity improving additive composition with 25, 50 and 100 parts of additive by weight per million parts by weight of fuel was plotted against its varying composition of A, B, C and D as shown in FIG. 4. Within the range of from about 25 to about 100 parts of additive by weight per million parts by weight of fuel was found to be 324, 313 and 420 micron respectively. From the combined experiments it was finalized that the lubricity improving additive fuel composition of A:B:C:D with varying composition of hexadecanoic acid, oleic acid, linoleic acid and linolenic acid was found to be 8:80:10:2 in 50 ppm parts of additive by weight per million parts by weight of fuel in BS-IV diesel fuel.

Example 24

Figure 5:
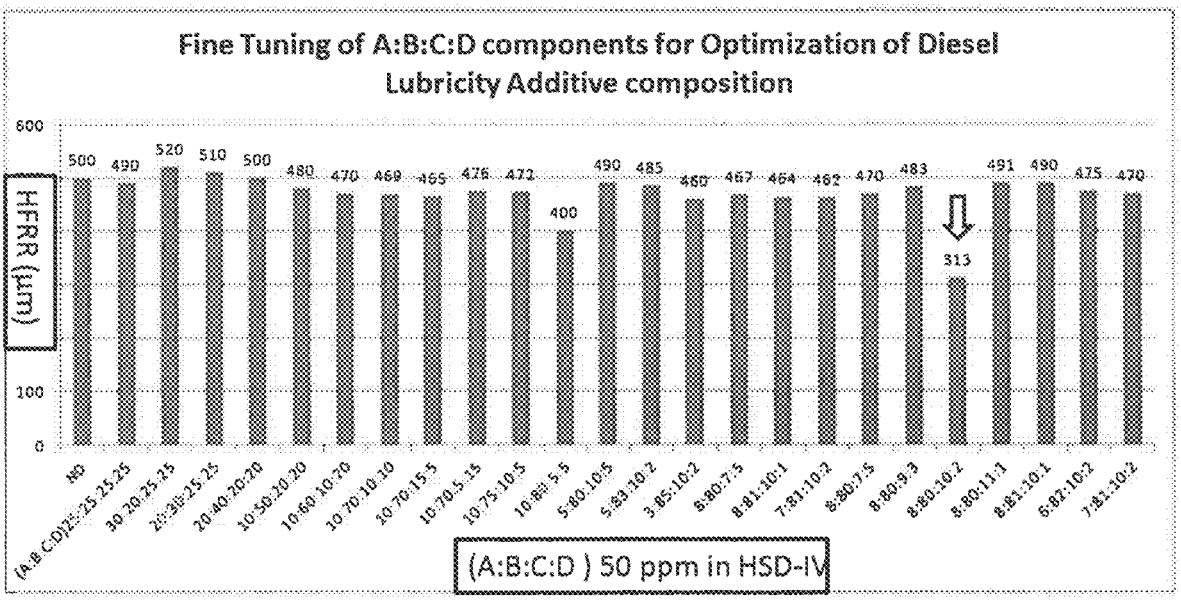
FIG. 5 depicts the graph showing HFRR. vs fuel additive composition @100 ppm in BS-IV diesel fuel.

In another typical example, we have done fine tuning to arrive at the final additive composition for lubricity increasing persoformance of the fuel additive composition (FIG. 5 and FIG. 6). A varying composition of A:B:C:D to arrive at 8:80:10:2 final composition was done with fine tuning of components A, B, C and D and was plotted with the fuel composition of said lubricity improving additive composition, which is a mixture of monosaturated and disaturated free fatty acid of hexadecanoic, oleic, linoleic and linolenic acid in varying ratio of A:B:C:D present in the fuel composition in an amount of about 50 parts of additive by weight per million parts by weight of fuel. The HFRR value of the lubricity improving additive composition with 50 parts of additive by weight per million parts by weight of fuel was plotted against its varying composition of A, B, C and D as shown in FIG. 5. From the graph plotted in FIG. 5 experiments it was finalized that the lubricity improving additive fuel composition of A:B:C:D with varying composition of hexadecanoic acid, oleic acid, linoleic acid and linolenic acid was found to be 8:80:10:2 in 50 ppm parts of additive by weight per million parts by weight of fuel in BS-IV diesel fuel was found to 313 μm.

Comparative Example

The additives from above Examples were examined on a High Frequency Reciprocating Rig (HFRR) in accordance with ASTM D6079 for their effectiveness to improve lubricity. The results are reported in Table 1 as mean Wear Scar Diameter (WSD) in micrometers. The effectiveness of improved lubricity was measured by a decrease in WSD when comparing the blank diesel fuel WSD to the WSD with additive blending in diesel, it may be seen that in each instance the reaction products from Examples 3-6 gave improved lubricity results as compared to no lubricity improving additive composition.

Response of lubricity with increased additive concentration had been observed. A method of improving the lubricity of a low-sulfur content diesel, where the method comprises adding to the diesel fuel an additive comprising hexadecanoic acid (A), oleic acid (B), linoleic acid (C) and linolenic acid (D) in the composition of (8:80:10:2) in the range of 50-100 ppm and there combinations thereof; and where the amount of the additive is effective to improve the lubricity property. The additive composition (A:B:C:D) in 8:80:10:2 ratio shows the effectiveness as lubricity improving additive in neat base diesel with less than 50 ppm sulfur or less.

TABLE 1

Effect of Lubricity Improving Additive Composition on Neat Diesel

| Fuel | Dosage/ Treat rate (ppm) | Component A (100%) | Component B (100%) | Component C (100%) | Component D (100%) | Component A:B:C:D (8:80:10:2) | Neat Diesel |
|---|---|---|---|---|---|---|---|
| HFRR (WSD) | 50 | 480 | 373 | 456 | 427 | 313 | |
| Microns | 100 | 404 | 390 | 470 | 476 | 361 | 502 |

From Table 1, it is clear that lubricity improving composition A:B:C:D has excellent HFRR response test and has no interaction with diesel and and other diesel fuel additives shows well equipped compatibility with the constituent materials of the engine and fuel system. Therefore the optimum dosage of lubricity improving chemical composition A:B:C:D is 8:80:10:2.

Table 2 shows the diesel fuel lubricity additive composition for arriving at final ratio of 8:80:10:2 of A:B:C:D of hexadecanoic acid:oleic acid:linoleic acid:linoleniclic acid components of diesel fuel lubricity additive composition.

TABLE 2

Diesel lubricity additive composition and its effects on HFRR

| S. NO | Component | | | | HFRR |
|---|---|---|---|---|---|
| 1 | Neat Diesel | | | | 500 |
| | Composition ratio | | | | |
| | A | B | B | D | |
| 2 | 25 | 25 | 25 | 25 | 490 |
| 3 | 30 | 20 | 25 | 25 | 520 |
| 4 | 20 | 30 | 25 | 25 | 510 |
| 5 | 20 | 40 | 20 | 20 | 500 |
| 6 | 10 | 50 | 20 | 20 | 480 |
| 7 | 10 | 60 | 10 | 20 | 470 |
| 8 | 10 | 70 | 10 | 10 | 469 |
| 9 | 10 | 70 | 15 | 5 | 465 |
| 10 | 10 | 75 | 5 | 15 | 476 |
| 11 | 10 | 75 | 10 | 5 | 472 |
| 12 | 10 | 80 | 5 | 5 | 400 |
| 13 | 5 | 80 | 10 | 5 | 490 |
| 14 | 5 | 83 | 10 | 2 | 485 |
| 15 | 3 | 85 | 10 | 2 | 460 |
| 16 | 8 | 80 | 7 | 5 | 467 |
| 17 | 8 | 81 | 10 | 1 | 464 |
| 18 | 7 | 81 | 10 | 2 | 462 |
| 19 | 8 | 80 | 7 | 5 | 470 |
| 20 | 8 | 80 | 9 | 3 | 483 |
| 21 | 8 | 80 | 10 | 2 | 313 |
| 22 | 8 | 80 | 11 | 1 | 491 |
| 23 | 8 | 81 | 10 | 1 | 490 |
| 24 | 6 | 82 | 10 | 2 | 475 |
| 25 | 7 | 81 | 10 | 2 | 490 |

Table 3 Shows the Cost Effectiveness of Said Lubricity Improving Composition A98):B(80):C(10):C(2).

| S. NO | Component >95% purity | Cost Rs/ (100 g) | A:B:C:D (8:80:10:2) |
|---|---|---|---|
| 1 | A: Hexadecanoic acid | 32,669 | 8% of A cost: 2613.52 Rs |
| 2 | B: Oleic acid | 51,380 | 80% of B cost: 41104.0 Rs |
| 3 | C: Linoleic acid | 26,246 | 10% of C cost: 2624.6 Rs |

-continued

| S. NO | Component >95% purity | Cost Rs/ (100 g) | A:B:C:D (8:80:10:2) |
|---|---|---|---|
| 4 | D: Linolenic acid | 76,995 | 2% of D cost: 1539.9 Rs |
| 5 | Total | Rs, 1,87,290 | Rs, 47,882.02 |
| 6 | Cost effective is by Rs. 1,39,407.98 if we use A:B:C:D in the ratio of 8:80:10:2 for 100 g of the lubricity improving fuel additive. The composition proves to be cost effective than using pure component of B, C or D which has lubricity improving capability. | | |

Example 25

Process Steps and Reaction Conditions:

Blending Process: a) Neat diesel fuel sample was sourced from refinery hydrocracker plant with sulphur varying from 30-50 ppm without any additive was measured for HFRR. b) The HFRR value was found to be 502 for the neat diesel sample which ich is not meeting the BIS specification of HFRR 460 micron. c) A lubricity improving additive composition comprises fatty acids components of saturated and unsaturated free fatty acids labeled A, B, C and D chemicals Palmitic acid, oleic acid, linoleic acid and linolenic acid respectively are purchased from Aldrich, India, d) 50 ppm of the fuel composition of said lubricity improving additive composition, component A, B, C and D in the ratio of 8:80:10:2 are present in the fuel composition in an amount of 50 parts of additive by weight per million parts by weight of fuel. e) The HFRR value of the lubricity improving additive composition for the mixture of saturated and unsaturated fatty acids of component A, component B, component C and component D in the ratio of (8:80:10:2) with the amount about 50 parts of additive by weight per million parts by weight of fuel was found to be 313 micron respectively. f) All the experiment process was carried out at room temperature 25-27° C. All the weights of the individual components are taken by weights for making the fuel additive composition comprising of A:B:C:D in the ratio of 8:80:10:2. The Lubricity additive fuel composition is made in solvent-free condition.

(I) Experimental Data for the Composition A:B:C:D at Other Concentrations

| Composition | HFRR (WSD) |
|---|---|
| ND | 502 |
| (8:80:10:2) A + B + C + D10 ppm | 501 |
| (8:80:10:2) A + B + C + D 25 ppm | 420 |
| (8;80:10:2) A + B + C + D 50 ppm | 313 |
| (8:80:10:2) A + B + C + D100 ppm | 324 |
| (8:80:10:2) A + B + C + D150 ppm | 474 |
| (8:80:10:2) A + B + C + D200 ppm | 524 |

(II) Experimental Data for the Composition A:B:C:D at Lower Temperatures

| Composition | HFRR (WSD) (37° C.) | HFRR (WSD) (5-10° C.) |
|---|---|---|
| ND | 502 | 502 |
| (8:80:10:2) A + B + C + D10 ppm | 501 | 502 |
| (8:80:10:2) A + B + C + D 25 ppm | 420 | 460 |
| (8:8:10:2) A + B + C + D 50 ppm | 313 | 300 |
| (8:80:10:2) A + B + C + D100 ppm | 324 | 480 |
| (8:80:10:2) A + B + C + D150 ppm | 474 | 520 |
| (8:80:10:2) A + B + C + D200 ppm | 524 | 560 |

The most significant parameter affecting the results of the HFRR test is the presence of lubricity additives that can:

Reduce wear

Prevent micro-seizure

Negate the impact of other variables such as strokelength.

The high HFRR value indicates more wear scar diameter (WSD) there is more wear and tear.

The low HFRR value looked at the impact of lubricity additive-based surface coatings, which are used to improve the antiwear performance of engineered parts.

Thus in the Experimental Result (I) and (II) the HFRR (313) data indicates that these coatings do not replace the need for fuels with good lubricity, but the presence of additives can help to prolong the coatings' lifetime.

TABLE 4

Low temperature properties of ultra low sulfur diesel with lubricity additive composition and individual component.

| Sample | Blend ratio | CPT (° C.) | PPT (° C.) |
|---|---|---|---|
| ULSD | 0 | −7 | −9 |
| A:B:C:D | 50 ppm (8:80:10:2) | −3 | −37 |
| A | 0 (100% A) | 16 | −5 |
| B | 0 (100% B) | 8 | −9 |
| C | 0 (100% C) | 9 | −18 |
| D | 0 (100% D) | 10 | −27 |

When using a lubricity additive it is important to ensure that the additive remains homogeneous during storage and injection. Some mono-acidic additives have a relatively high cloud point, meaning that precipitation can happen at normal winter ambient temperatures. In this case dilution or heated storage may be required. Another important consideration is the solubility of the lubricity additive in diesel fuel when exposed to low temperatures. Some lubricity additives are known to have only limited solubility in fuel after prolonged storage at low ambient temperatures.

Therefore, the Table 4 describes the importance to distinguish the unexpected results obtained by the interaction in polymeric insoluble's from dimer acids which is not possible with an undimerized fatty acid. This is because in undimerized fatty acid there is only one polar head group on a monoacid molecule and hence a polymer-type structure cannot be formed. As added assurance, our fuel lubricity improving composition conducts lubricating oil interaction tests on all its lubricity additives to ensure no side reactions are occurring and thus the lubricity additive of the present disclosure is stable at low temperatures as compared to the individual components.

Although the subject matter has been described in considerable detail with reference to certain examples and implementations thereof, other implementations are possible. As such, the spirit and scope of the appended claims should not be limited to the description of the preferred examples and implementations contained therein.

Advantages gained in the example illustrative compositions of this subject matter:

The present disclosure describes the composition that enhance the lubricity of diesel, making, clear homogenous mixture and free flow able liquid at ambient as well as low temperature, Another objective of the present disclosure is to develop the lubricity improver composition from readily available raw material.

Further the lubricity improver composition of the present disclosure is effective at optimized dosage.

The present disclosure further provides a lubricity improver composition comprising of a liquid diesel fuel having less than 50 ppm by weight sulfur and 50-100 ppm of the lubricity improver composition consisting of free fatty acid and unsaturated fatty acids.

The composition of the present disclosure is formulated in such a way to meet the more severe cold temperature handling requirements of the northern region and for its maximum activity and efficiency to take advantage of warmer temperatures in southern and west coast regions.

The present disclosure further provides the technical advancement of the lubricity improver composition in diesel which are used for a wide variety of purposes such as in engine and fuel delivery system performance, Fuel handling, Fuel stability and Contaminant control.

What is claimed is:

1. A fuel composition imparting a lubricant property, the fuel composition consisting of:

a fuel selected from the group consisting of diesel, kerosene, gasoline, jet fuel, and combinations thereof and having a sulphur concentration less than 50 ppm; and an additive consisting of palmitic acid (A), oleic acid (B), linoleic acid (C) and linolenic acid (D), wherein the ratio of A:B:C:D is 8:80:10:2;

wherein the fuel composition includes the additive at a concentration range of 50 to 100 parts by weight per millions parts by weight of the fuel.

2. A process for preparing a fuel composition as claimed in claim 1, comprising the steps of:

mixing the palmitic acid (A), oleic acid (B), linoleic acid (C) and linolenic acid (D) to form the additive; and contacting the additive with the fuel.

3. An additive for a fuel composition, the additive consisting of palmitic acid (A), oleic acid (B), linoleic acid (C) and linolenic acid (D), wherein the ratio of A:B:C:D is 8:80:10:2.

* * * * *